US005901811A

United States Patent [19]

Samples et al.

[11] Patent Number: 5,901,811

[45] Date of Patent: May 11, 1999

[54] APPARATUS AND METHOD FOR LUBRICANT DELIVERY TO AN ENGINE

[76] Inventors: Andrew L. Samples, 654 S. Saddle St., Gilbert, Ariz. 85233; Clark Thomas Sawyer, 3134 W. Lewis, #36, Phoenix, Ariz. 85009

[21] Appl. No.: 08/904,595

[22] Filed: Aug. 1, 1997

Related U.S. Application Data

[63] Continuation-in-part of application No. 08/613,156, Mar. 8, 1996, abandoned.

[51] Int. Cl.[6] ..... F01M 9/00

[52] U.S. Cl. ..... 184/6.3; 184/6.4; 184/55.1; 123/196 R

[58] Field of Search ..... 184/1.5, 6.3, 6.4, 184/6.12, 7.3, 7.4, 55.1; 123/196 R, 196 S

[56] References Cited

U.S. PATENT DOCUMENTS

| | | | |
|---|---|---|---|
| 4,359,140 | 11/1982 | Shreve | 184/6.3 |
| 4,444,292 | 4/1984 | Brown et al. | 184/6 |
| 4,513,705 | 4/1985 | Evans | 123/196 |
| 4,524,734 | 6/1985 | Miller | 123/196 |
| 4,632,080 | 12/1986 | Hurner | 123/196 |
| 4,893,598 | 1/1990 | Stasiuk | 123/196 |
| 5,238,085 | 8/1993 | Engelmann | 184/1.5 |
| 5,318,080 | 6/1994 | Viken | 184/1.5 |
| 5,474,042 | 12/1995 | Kaneda | 123/196 S |
| 5,511,522 | 4/1996 | Tran | 123/196 S |
| 5,694,896 | 12/1997 | Melvin | 123/196 S |

*Primary Examiner*—John A. Jeffery
*Assistant Examiner*—David Fenstemacher
*Attorney, Agent, or Firm*—Meschkow & Gresham, P.L.C.; Jordan M. Meschkow; Lowell W. Gresham

[57] ABSTRACT

A lubricant reserve system (10) includes a reservoir tank (18) coupled to an accumulator T fitting (22). Additionally, coupled to the accumulator T fitting (22) is an accumulator pressure monitoring system (24) and an electronically-actuated valve (28). The reservoir tank (18) is adapted to hold a quantity of lubricant and a volume of gas having a gas pressure. The valve (28) opens in response to a control signal generated prior to ignition of an internal combustion engine (12) to prime the engine and closes when the engine (12) is disabled. The accumulator pressure monitoring system (24) is adapted to provide an indication of sufficient priming of the engine (12) prior to ignition of the engine (12). System (10) discharges lubricant (38) from the reservoir tank (18) while the engine (12) is running when the gas pressure is greater than a lubricant pressure of the engine lubrication system (13). Likewise, system (10) accumulates lubricant (38) in the reservoir tank (18) while the engine (12) is running and the gas pressure is less than the lubricant pressure of the engine lubrication system (13).

16 Claims, 3 Drawing Sheets

APPARATUS AND METHOD FOR LUBRICANT DELIVERY TO AN ENGINE

CROSS REFERENCE TO RELATED APPLICATION

This application is a CIP of application Ser. No. 08/613,156, filed Mar. 8, 1996, now abandoned.

BACKGROUND OF THE INVENTION

1. Field of the Invention

The present invention relates generally to lubrication systems for internal combustion engines. More particularly, the present invention relates to oil reserve systems that supplement internal combustion engine lubrication systems.

2. The Prior Art

Lubrication systems for internal combustion engines are well known in the art. Typically, a lubrication system circulates motor oil within an engine crankcase to enable the internal parts to operate smoothly. The motor oil also protects the moving parts against excessive wear and tear that may otherwise be caused by frictional forces and high operating temperatures. Most conventional lubrication systems utilize an oil pump to transport the motor oil and to maintain an adequate amount of oil pressure within the system. Unfortunately, such conventional systems may not provide adequate protection under certain conditions.

A large amount of engine wear often occurs immediately following engine startup. For a short time following ignition there is little or no oil protecting the engine parts because the oil pump has not established sufficient oil pressure within the system. An engine can experience thousands of startups over its lifetime, and the short intervals of unlubricated operation can account for a large percentage of total engine wear.

Oil priming systems have been developed to address this shortcoming of conventional lubrication systems. A typical priming system establishes a flow of motor oil through the oiling system before the engine is started. Unfortunately, such systems can be expensive and difficult to install. In addition, such systems may utilize electronic pumps and electronic control modules that must be manipulated whenever the priming system is activated.

Another problem found with typical priming systems is that the operator has no indication that a sufficient quantity of motor oil has flowed into the engine prior to starting the engine. If the priming system is not working adequately there may be little or no oil protecting the engine during ignition, and the operator may be unknowingly adding wear and tear to the engine.

An engine may experience a temporary loss or reduction in oil pressure under certain adverse operating conditions. For example, the crankcase oil may be forced away from the engine oil pump if the automobile engages in hard cornering, steep climbing, hard braking, rapid acceleration, and the like. An engine can suffer severe damage if it operates without delivering oil to the internal parts, especially if the engine is operating under high RPMs.

Conventional oil reserve systems provide an "emergency" supply of oil to the engine lubrication system when the engine oil pressure falls below a normal operating pressure. When the oil pressure returns to normal, excess oil is accumulated and stored in an oil reservoir. Although such oil reserve systems may provide adequate protection against oil pressure loss when an engine is operating, they may not be capable of protecting an engine during startup (when the engine oiling system is not primed with oil). In addition, some oil reserve systems must be manually activated prior to use and manually deactivated following use. Consequently, such systems are rendered useless if the operator forgets to activate the system and the oil reservoir is unintentionally cut off from the engine lubrication system.

SUMMARY OF THE INVENTION

Accordingly, it is an advantage of the present invention that an improved lubricant reserve system and method for delivering lubricant to an engine are provided.

Another advantage of the present invention is that it provides a relatively inexpensive lubricant reserve system that primes the lubrication system of an engine prior to ignition of the engine.

Another advantage is that the lubricant reserve system includes a small number of parts and is relatively easy to install.

A further advantage is that the lubricant reserve system automatically primes an engine lubrication system without utilizing an electronic oil pump.

Another advantage is that the lubricant reserve system provides an indication system for informing an operator of a sufficient level of oil in the engine prior to engine startup.

Yet another advantage is that the lubricant reserve system provides an emergency supply of oil when an engine experiences a temporary loss or reduction in oil pressure and primes the engine oiling system prior to ignition.

A further advantage is that an electronically-activated lubricant reserve system is provided.

The above and other advantages of the present invention are carried out in one form by a lubricant reserve system for delivering engine lubricant to an internal combustion engine. The lubricant reserve system includes a reservoir tank adapted to hold a quantity of lubricant and a volume of gas having a gas pressure. The reservoir tank has an access opening formed therein. An accumulator T fitting has a first port in fluid communication with the access opening, a second port configured for delivery of a first lubricant portion of the quantity of lubricant, and a third port configured for delivery of a second lubricant portion of the quantity of lubricant. An accumulator pressure monitoring system has an accumulator pressure indicator and a sensing end. The sensing end is coupled to the second port and is configured to receive the first lubricant portion which exhibits a fluid pressure. An electronically-actuated valve has a first opening in fluid communication with the third port and a second opening configured for fluid communication with an engine lubrication system. The first and second lubricant portions are discharged from the reservoir tank when the valve is open and the gas pressure is greater than the fluid pressure. Additionally,an amount of the first and second lubricant portions are accumulated in the reservoir tank when the valve is open and the gas pressure is less than the fluid pressure.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENT

Figure 1:
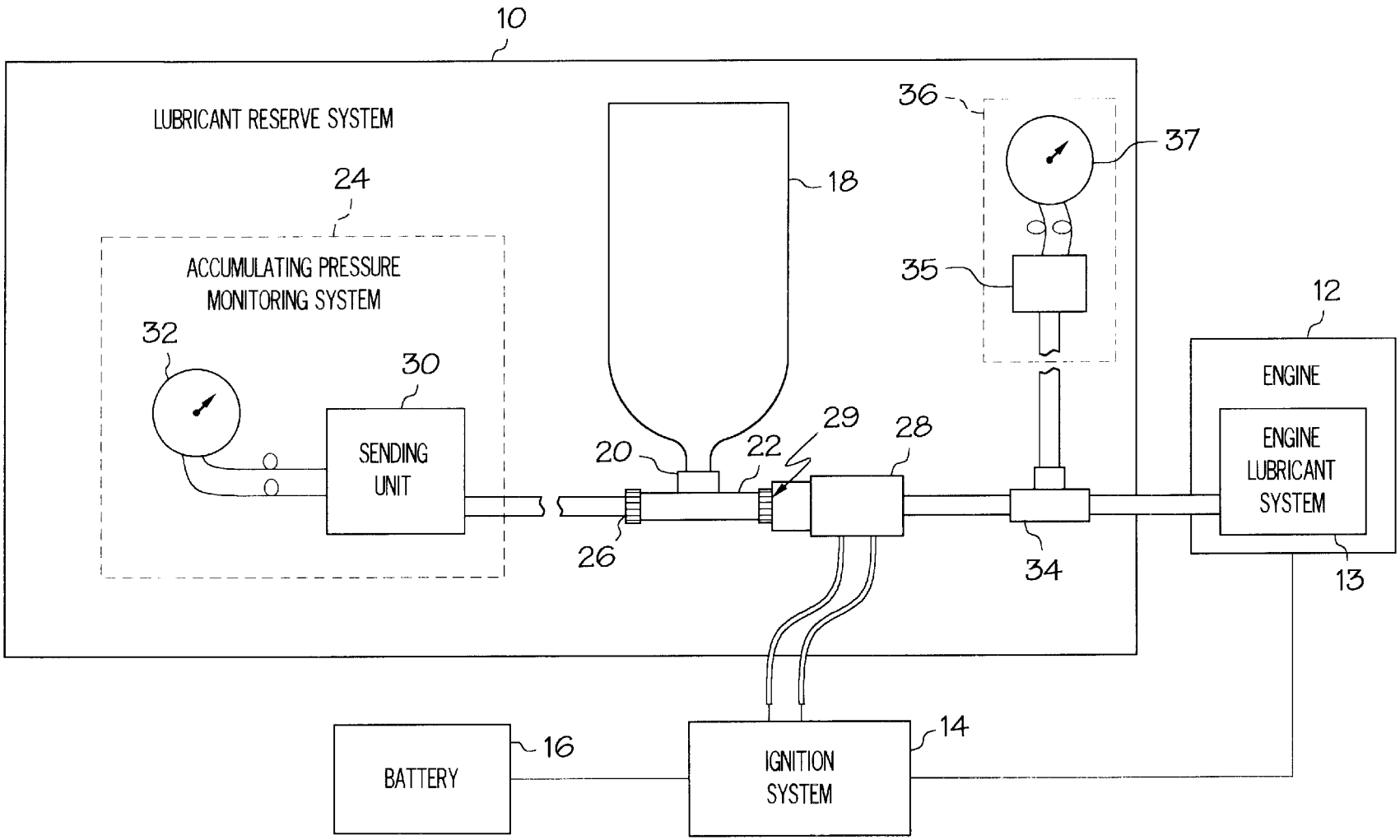
FIG. 1 shows a schematic representation of an exemplary environment in which a lubricant reserve system may operate.

FIG. 1 shows a lubricant reserve system 10 along with several elements with which it may cooperate. For convenience, system 10 is described herein in conjunction with an automobile engine. However, system 10 may be adapted for use with a variety of engines and motors that employ internal lubrication methodologies, and system 10 is not limited to automotive uses. System 10 is configured to deliver engine lubricant to an internal combustion engine 12 as necessary to maintain an adequate oil pressure within engine 12. In addition, system 10 is capable of priming an engine lubrication system 13 with lubricant prior to ignition of engine 12.

System 10 is in fluid communication with engine lubrication system 13 such that motor oil (or any suitable lubricating substance) can flow between system 10 and engine lubrication system 13. According to the preferred embodiment, system 10 and engine 12 are both electronically connected to an ignition system 14, which is electronically connected to a battery 16. When activated, ignition system 14 employs conventional technologies to enable engine 12 to begin and sustain operation. In addition, ignition system 14 also provides operating power from battery 16 to system 10 (described in more detail below).

System 10 can be mounted in any convenient location proximate engine 12. For example, system 10 may be attached to a vehicle firewall or other body section via mounting straps or brackets (not shown). Preferably, the distance between system 10 and engine 12 is kept relatively short to reduce pressure losses and transport delay of the lubricant.

Generally, system 10 includes a reservoir tank 18 coupled to a first port 20 of an accumulator T fitting 22. An accumulator pressure monitoring system 24 is coupled to a second port 26 of accumulator T fitting 22, and an electronically-actuated valve 28 is coupled to a third port 29 of accumulator T fitting 22. Reservoir tank 18, accumulator T fitting 22, and electronically-actuated valve 28 are formed from a material, such as aluminum, that can withstand the operating pressures produced by engine lubrication system 13. In the preferred embodiment, reservoir tank 18 has an interior volume between thirty-two and sixty-four fluid ounces.

Accumulator pressure monitoring system 24 includes a sending unit 30 and accumulator pressure indicator 32. Sending unit 30 is the sensing end of accumulator pressure monitoring system 24 and is coupled to second port 26. Sending unit 30 and accumulator pressure indicator 32 may be conventional elements that are configured specifically for the fluid pressures that are produced in system 10.

Electronically-activated valve 28 is also coupled to a lubricant T fitting 34. Lubricant T fitting 34 is then coupled to a total pressure monitoring system 36, which has a sensing end 35 and a lubricant pressure indicator 37, and to engine lubricant system 13 of engine 12.

Figure 2:
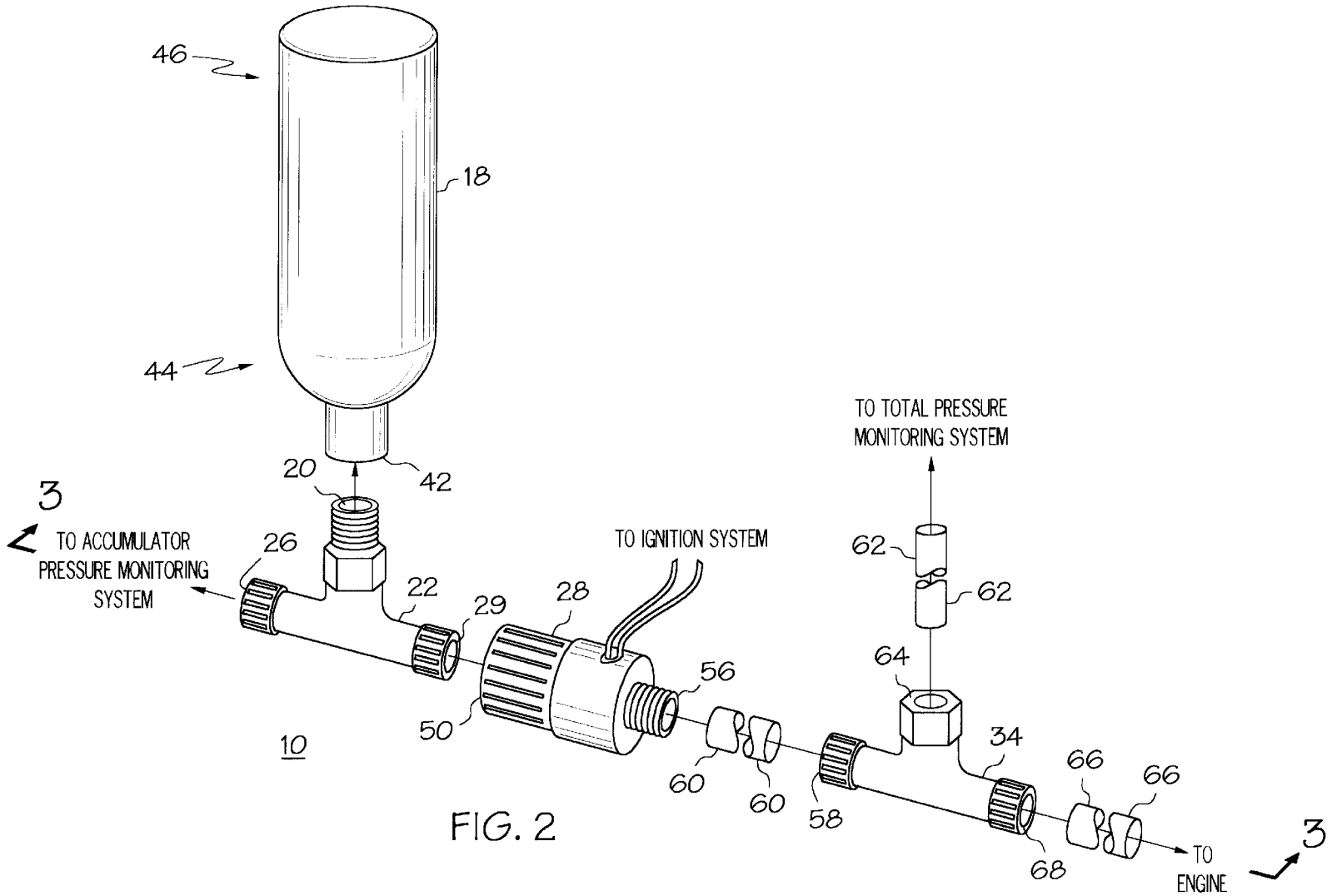
FIG. 2 shows a perspective view of a lubricant reserve system according to the preferred embodiment of the present invention.
Figure 3:
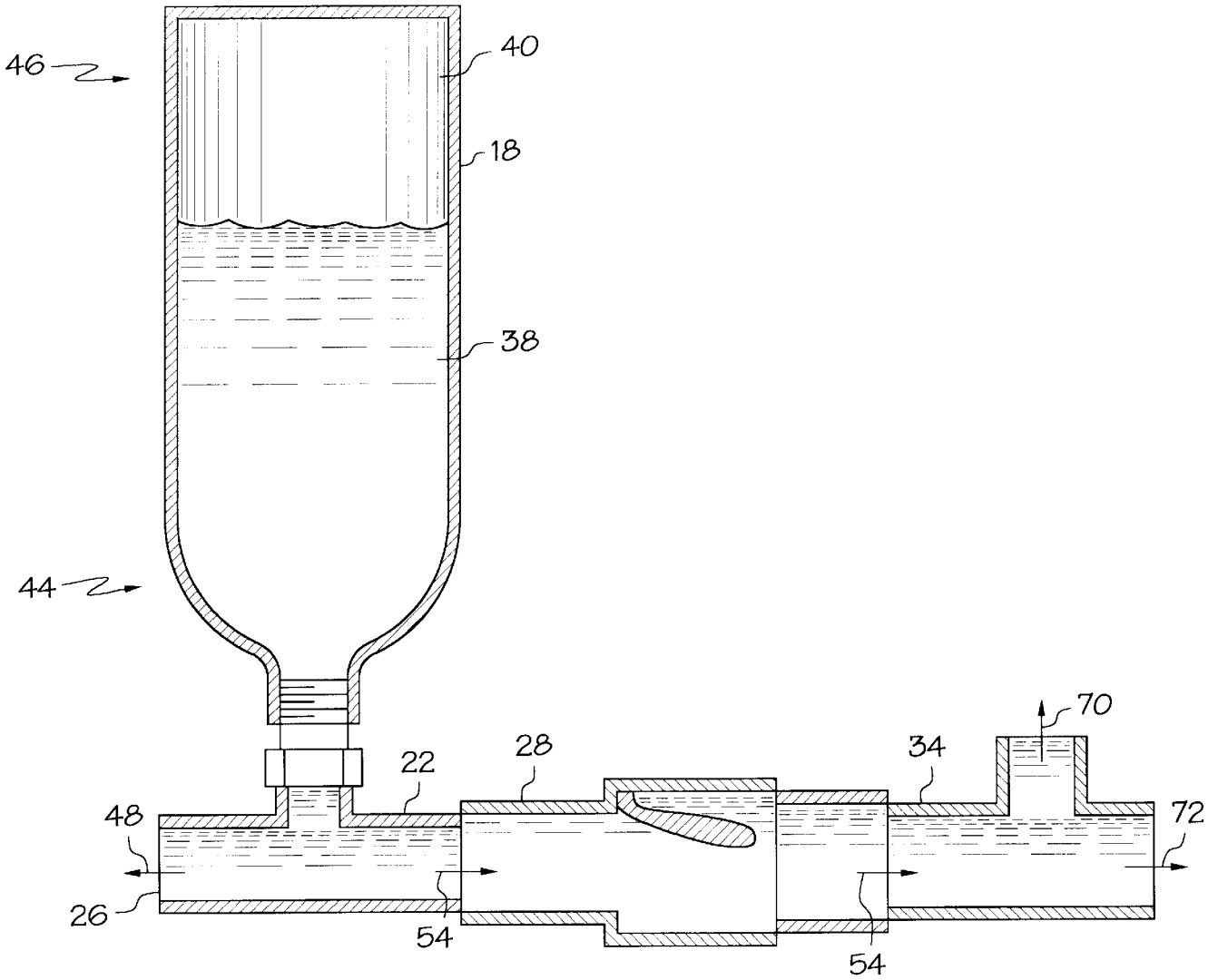
FIG. 3 shows a partial sectional side view of the lubricant reserve system shown in FIG. 2.

With reference to FIGS. 2–3, FIG. 2 shows a perspective view of system 10 and FIG. 3 shows a partially sectioned side view. Reservoir tank 18 is adapted to hold a quantity of lubricant 38 and a volume of gas 40 having a gas pressure (see FIG. 3). During the initial installation of system 10, the user may partially fill reservoir tank 18 with a quantity of lubricant 38. Alternatively, if system 10 is initially installed with reservoir tank 18 empty, then additional lubricant can be added to engine lubrication system 13. After starting engine 12, an amount of lubricant 38 will eventually flow into reservoir tank 18.

An access opening 42 is formed in a lower end 44 of reservoir tank 18. Lubricant 38 flows into and out of reservoir tank 18 through access opening 42. In a preferred configuration, lubricant 38 is held within reservoir tank 18 proximate lower end 44 and the volume of gas 40 is held within reservoir tank 18 proximate an upper end 46 thereof. "Lower end" and "upper end" are used herein for convenience to describe system 10 relative to a preferred mounting position. The performance of system 10 may be enhanced if reservoir tank 18 is mounted such that its longitudinal axis is approximately vertical under typical operating conditions. This mounting position enables system 10 to take advantage of gravitational forces when delivering lubricant 38 to engine 12.

First port 20 of accumulator T fitting 22 is in fluid communication with access opening 42 for delivery of a quantity of lubricant 38. Second port 26 is configured for delivery of a first lubricant portion 48 of lubricant 38 to accumulator pressure monitoring system 24 (see FIG. 1). First lubricant portion 48 has a fluid pressure, and sending unit 30 (see FIG. 1) is configured to send an electrical signal to accumulator pressure indicator 32 (see FIG. 1) in response to the fluid pressure.

Accumulator pressure indicator 32 indicates the status of the fluid pressure. For example, accumulator pressure indicator 32 may be a gauge that is configured to provide a readout of the fluid pressure of first lubricant portion 48. Alternatively, accumulator pressure indicator 32 may be an illuminated lamp that is configured to extinguish when the fluid pressure is at a level indicating sufficient prelubrication of internal combustion engine 12. For instance, a sufficient level for engine lubrication system 13 in an automobile may be approximately five pounds per square inch. Accumulator pressure monitoring system 24 is desirably located distally from reservoir tank 18 in a location so that accumulator pressure indicator 32 is readily visible to an operator such as in the dashboard of an automobile for easy viewing by the driver. Thus, this visibility feature provides an indication to the operator of the fluid pressure prior to ignition of engine 12.

Electronic valve 28 has a first opening 50 in fluid communication with third port 29 of accumulator T fitting 22. Electronic valve 28 regulates the flow of a second lubricant portion 54 of lubricant 38 between reservoir tank 18 and engine lubrication system 13. Electronic valve 28 has a second opening 56 configured for fluid communication with engine lubrication system 13 through lubricant T fitting 34.

Electronic valve 28 is configured to respond to an electronic signal generated by ignition system 14 (see FIG. 1). In the preferred embodiment, electronic valve 28 is solenoid-activated by a control voltage from ignition system 14. In other words, electronic valve 28 remains open while the control voltage is applied and closes when the control voltage is removed. Solenoid switches and electronic valves are known to those skilled in the art and will not be described in detail herein.

To facilitate easy installation, reservoir tank 18, accumulator T fitting 22, electronic valve 28, and lubricant T fitting 34 may be configured to receive standard threaded adapters, fittings, and/or hose connectors (not shown). For example, lubricant reserve system 10 may include an input/output fitting (not shown) that couples second opening 56 to a first port 58 of lubricant T fitting 34 via a hose 60. Likewise, a hose 62 may couple a second port 64 of lubricant T fitting 34 to total pressure monitoring system 36 (see FIG. 1) and a hose 66 may couple a third port 68 of lubricant T fitting 34 to engine lubricant system 13 (see FIG. 1). Such interconnecting devices are well known in the automotive field.

Lubricant T fitting 34 is configured to route second lubricant portion 54 to engine 12. Second lubricant portion 54 is routed through lubricant T fitting 34 so that a first subportion 70 of portion 54 is delivered through second port 64 to total pressure monitoring system 36, and a second subportion 72 is delivered through third port 68 to engine lubrication system 13 (see FIG. 1). Sensing end 35 (see FIG. 1) is coupled to second port 64 and is configured to receive first subportion 70. Engine 12 (see FIG. 1) exhibits a total lubricant pressure. The total lubricant pressure is a combined total of the fluid pressure from reservoir 18 and the lubricant pressure inside engine lubricant system 13. Sensing end 35 is configured to send an electrical signal to lubricant pressure indicator 37 (see FIG. 1) which is responsive to the total lubricant pressure.

In the preferred embodiment, total pressure monitoring system 36 (see FIG. 1) may be a conventional oil pressure sending unit and indicator found in automobiles. Lubricant pressure indicator 37 may be a gauge that is configured to indicate the total pressure. Alternatively, lubricant pressure indicator 37 may be a lamp that is configured to illuminate when the total lubricant pressure is lower than a predetermined level.

System 10 is illustrated with both accumulator pressure monitoring system 24 and total pressure monitoring system 36. However, those skilled in the art will recognize that both monitoring systems need not be used. If total pressure monitoring system 36 is configured with an appropriate scale to indicate a total lubricant pressure during engine 12 priming, then accumulator pressure monitoring system 24 may not be needed. In this alternative embodiment, electronic valve 28 may be coupled directly to reservoir tank 18 without the use of accumulator T fitting 22. Whether a pressure readout comes from accumulator pressure indicator 32 or lubricant pressure indicator 37, an operator will be able to determine if engine 12 is sufficiently primed prior to ignition of engine 12.

A typical engine often operates under little or no oil pressure immediately following ignition. Thus, each "unlubricated" startup contributes to the overall wear and tear of the engine. System 10 is configured to prime engine lubrication system 13 with an amount of lubricant prior to ignition. Consequently, system 10 functions to reduce the wear and tear normally associated with engine startups.

Prior to ignition of engine 12, reservoir tank 18 is partially full of lubricant 38 and partially full of gas 40. Electronic valve 28 is closed and gas 40 is held under an initial bias pressure. This initial bias pressure may be adjusted by the user via regulator valve (not shown) or, as described below, it may be achieved by the inherent operation of system 10 following shutdown of engine 12.

Electronic valve 28 opens in response to an electronic signal generated prior to ignition of engine 12. In the preferred embodiment, the electronic control signal is obtained from ignition system 14 (see FIG. 1). For example, the control signal may be produced when the operator engages an ignition switch (not shown). It should be appreciated that system 10 may incorporate an electronic delay element (not shown) that prevents engine 12 from starting for an amount of time following the opening of electronic valve 28.

After electronic valve 28 opens, an amount of lubricant 38, such as second subportion 72, is delivered from reservoir tank 18 to engine lubrication system 13. It should be readily apparent that first portion 48, second portion 54, first subportion 70, and second subportion 72 are all subsets of lubricant 38 and have been separated merely to describe the routing of lubricant 38 within system 10. The delivery of second subportion 72 may be expedited by the difference between the pressure of gas 40 and the static fluid pressure of engine lubrication system 13. If system 10 is mounted such that reservoir tank 18 is substantially upright, then the flow of lubricant 38 from reservoir tank 18 may also be assisted by the force of gravity.

Electronic valve 28 is configured to remain open while engine 12 is operating. In other words, electronic valve 28 is held open for as long as the electronic control signal from ignition system 14 is applied to electronic valve 28. Consequently, electronic valve 28 closes when engine 12 is disabled and the electronic signal from ignition system 14 is removed.

Under typical operating conditions, engine 12 maintains a relatively steady oil pressure and the lubricant pressure of engine lubrication system 13 is approximately equal to the pressure of gas 40 within reservoir tank 18. On the other hand, engine 12 can experience a temporary loss or reduction in oil pressure in a variety of situations. For example, the engine oil supply may be forced away from the oil pump when the vehicle performs tight cornering, steep climbing, or hard braking. When this occurs, engine 12 may suffer damage due to short-term oil starvation. In response to such a temporary reduction in oil pressure, system 10 provides a reserve amount of lubricant 38 from reservoir tank 18.

As discussed above, gas 40 is maintained at a gas pressure approximately equal to the normal operating lubricant pressure of engine 12. As such, lubricant 38 substantially remains within reservoir tank 18 under normal operating conditions. However, an amount of lubricant 38 is discharged from reservoir tank 18 when electronic valve 28 is open and the pressure of gas 40 is greater than the fluid pressure at third port 68 (see FIG. 2). To ensure that system 10 reacts quickly to pressure loss in engine lubrication system 13, third port 68 may be coupled near to the output side of the engine oil pump (not shown). When normal operating conditions resume, the engine lubricant pressure increases to the normal operating pressure. Consequently, an amount of lubricant 38 is accumulated in reservoir tank 18 when electronic valve 28 is open and the pressure of gas 40 is less than the fluid pressure at third port 68.

When electronic valve 28 is open and engine 12 is running, the volume of gas 40 increases or decreases according to the lubricant pressure established by engine lubrication system 13. When the engine lubricant pressure falls, gas 40 forces lubricant 38 out of reservoir tank 18 and into engine lubrication system 13. Conversely, when the engine oil pressure returns to a normal value, lubricant 38 flows into reservoir tank 18 and compresses gas 40. Thus, system 10 delivers and accumulates an emergency reserve of lubricant 38 in response to variations in engine lubricant pressure.

As described above, electronic valve 28 preferably remains open while engine 12 is operating. When ignition system 14 disables engine 12, the electronic control signal to electronic valve 28 is removed. Consequently, electronic valve 28 closes to prevent lubricant flow between reservoir tank 18 and engine lubrication system 13 when engine 12 is shut down. When electronic valve 28 closes, a quantity of lubricant 38 is contained within reservoir tank 18 and the current operating pressure of gas 40 is maintained within reservoir tank 18. The electrical response time required to close electronic valve 28 is relatively short and system 10 discharges little or no lubricant 38 from reservoir 18 during the response time.

The static gas pressure within reservoir 18 is desirably preserved until ignition system 14 is reactivated. As described above, the static pressure of gas 40 causes an amount of lubricant 38, such as second subportion 72, to flow into engine lubrication system 13 prior to ignition. Thus, engine lubrication system 13 is automatically primed each time the user starts engine 12. The operator need not manipulate any devices or controls other than a conventional ignition switch. Additionally, the operator may determine from the readout on either accumulator pressure indicator 32 or lubricant pressure indicator 37 when engine lubrication system 13 is sufficiently primed.

In summary, the present invention provides an improved lubricant reserve system for delivering lubricant to an engine. Although the system is electronically activated, it does not require an electronic pump. The system is capable of priming an engine lubrication system prior to ignition of the engine and the system is configured with an indication system for informing an operator of a sufficient priming prior to engine startup. The lubricant reserve system is relatively inexpensive, it includes a small number of parts, and it is relatively easy to install. In addition, the lubricant reserve system provides an emergency supply of oil when the engine experiences a temporary loss or reduction in oil pressure.

The above description is of a preferred embodiment of the present invention, and the invention is not limited to the specific embodiment described and illustrated. For example, the control signal for the electronic valve need not be provided by an ignition system. Furthermore, many variations and modifications will be evident to those skilled in this art, and such variations and modifications are intended to be included within the spirit and scope of the invention, as expressed in the following claims.

What is claimed is:

1. A lubricant reserve system for delivering engine lubricant to an internal combustion engine through an engine lubrication system of said engine, said lubricant reserve system comprising:

an accumulator adapted to hold a quantity of lubricant exhibiting a fluid pressure and a volume of gas having a gas pressure, said accumulator having an access opening formed therein;

an accumulator T fitting having a first port in fluid communication with said access opening, a second port configured for delivery of a first lubricant portion of said quantity of lubricant, and a third port configured for delivery of a second lubricant portion of said quantity of lubricant;

an accumulator pressure monitoring system having an accumulator pressure indicator and a sensing end, said sensing end being coupled to said second port and configured to receive said first lubricant portion in order to monitor said fluid pressure of said quantity of lubricant in said accumulator; and an electronically-actuated valve having a first opening in fluid communication with said third port and a second opening configured for fluid communication with said engine lubrication system; wherein said first and second lubricant portions are discharged from said accumulator when said electronically-actuated valve is open and said gas pressure is greater than said fluid pressure; and an amount of said first and second lubricant portions is accumulated in said accumulator when said electronically-actuated valve is open and said gas pressure is less than said fluid pressure.

2. A lubricant reserve system as claimed in claim 1 wherein:

said access opening is formed in a lower end of said accumulator;

said volume of gas is held within said accumulator proximate an upper end thereof; and said quantity of lubricant is held within said accumulator proximate said lower end.

3. A lubricant reserve system as claimed in claim 1 wherein said electronically-actuated valve is configured to open in response to an electronic signal generated by an ignition system prior to ignition of said internal combustion engine.

4. A lubricant reserve system as claimed in claim 3 wherein:

said electronically-actuated valve is configured to remain open while said internal combustion engine is operating;

said electronically-actuated valve is configured to close when said internal combustion engine is disabled; and an operating gas pressure is maintained within said accumulator by said quantity of lubricant when said electronically-actuated valve is closed.

5. A lubricant reserve system as claimed in claim 1 wherein said accumulator pressure indicator is distally located from said accumulator and in a location that is readily visible to an operator.

6. A lubricant reserve system as claimed in claim 1 wherein said sensing end is a sender unit configured to send an electrical signal to said accumulator pressure indicator, said electrical signal being responsive to said fluid pressure.

7. A lubricant reserve system as claimed in claim 1 wherein said accumulator pressure indicator is a gauge configured to provide a readout of said fluid pressure.

8. A lubricant reserve system as claimed in claim 1 wherein said accumulator pressure indicator is an illuminated lamp configured to extinguish after said fluid pressure is at a level indicating sufficient prelubrication of said internal combustion engine.

9. A lubricant reserve system as claimed in claim 8 wherein said level is approximately five pounds per square inch.

10. A lubricant reserve system as claimed in claim 1 additionally comprising a lubricant T fitting coupled to said second opening of said electronically-actuated valve, said lubricant T fitting being configured to route said second lubricant portion to said internal combustion engine.

11. A lubricant reserve system as claimed in claim 10 wherein said system additionally comprises a total lubricant pressure monitoring system in fluid communication with said lubricant T fitting, said total lubricant pressure monitoring system being configured to indicate a total lubricant pressure, wherein said total lubricant pressure is a combined total of said fluid pressure and a lubricant pressure exhibited by said engine lubrication system.

12. A lubricant reserve system for delivering engine lubricant to an internal combustion engine through an engine lubrication system of said engine, said lubricant reserve system comprising:

an accumulator adapted to hold a quantity of lubricant exhibiting a fluid pressure and a volume of gas having a gas pressure, said accumulator having an access opening formed therein;

an electronically-actuated valve having a first opening in fluid communication with said access opening and a second opening configured for fluid communication with said engine lubrication system;

a lubricant T fitting having a first port in fluid communication with said second opening, a second port configured for delivery of a first lubricant portion of said quantity of lubricant, and a third port configured for delivery of a second lubricant portion of said quantity of lubricant to said internal combustion engine; and a total pressure monitoring system having a lubricant pressure indicator and a sensing end, said sensing end being coupled to said second port and configured to receive said first lubricant portion in order to monitor said fluid pressure of said quantity of lubricant in said accumulator; wherein said first and second lubricant portions are discharged from said accumulator when said electronically-actuated valve is open and said gas pressure is greater than said fluid pressure; and said first and second lubricant portions are accumulated in said accumulator when said electronically-actuated valve is open and said gas pressure is less than said fluid pressure.

13. A lubricant reserve system as claimed in claim 12 wherein said lubricant pressure indicator is a gauge configured to indicate a total lubricant pressure, said total lubricant pressure being a combined total of said fluid pressure and a lubricant pressure exhibited by said engine lubrication system.

14. A lubricant reserve system as claimed in claim 12 wherein said lubricant pressure indicator is a lamp configured to illuminate when a total lubricant pressure of said internal combustion engine is lower than a predetermined level, said total lubricant pressure being a combined total of said fluid pressure and a lubricant pressure exhibited by said engine lubrication system.

15. A lubricant reserve system as claimed in claim 12 further comprising:

an accumulator T fitting having a first port coupled to said access opening, a second port configured to route a first amount of said quantity of lubricant, and a third port configured for routing said first and said second lubricant portions of said quantity of lubricant; and an accumulator pressure monitoring system having an accumulator pressure indicator and a sensing end, said sensing end being coupled to said second port and in fluid communication with said first amount of said quantity of lubricant, said first amount exhibiting said fluid pressure; wherein said sensing end is a sender unit configured to send an electrical signal responsive to said fluid pressure to said accumulator pressure indicator for indicating said fluid pressure.

16. A lubricant reserve system for delivering engine lubricant to an internal combustion engine through an engine lubrication system of said engine, said engine lubrication system exhibiting a lubricant pressure, said internal combustion engine being ignitable by an ignition system, and said lubricant reserve system comprising:

an accumulator adapted to hold a quantity of lubricant exhibiting a fluid pressure and a volume of gas having a gas pressure, said accumulator having an access opening formed therein;

an accumulator T fitting having a first port coupled to said access opening, a second port configured for delivery of a first lubricant portion of said quantity of lubricant, and a third port configured for delivery of a second lubricant portion of said quantity of lubricant;

an accumulator pressure monitoring system coupled to said second port, for indicating said fluid pressure of said first lubricant portion flowing from said accumulator;

a valve system for regulating flow of said second lubricant portion between said accumulator and said engine lubrication system, said valve system configured to be responsive to an electronic signal generated by said ignition system prior to ignition of said internal combustion engine; and a second pressure monitoring system for indicating a total lubricant pressure, said total lubricant pressure being a combined total of said fluid pressure and said lubricant pressure; wherein said lubricant reserve system is configured to allow said second lubricant portion to flow into said engine lubrication system prior to ignition of said engine;

said lubricant reserve system is configured to allow said volume of gas to force said second lubricant portion into said engine lubrication system after ignition of said engine when said gas pressure is greater than said total lubricant pressure; and said lubricant reserve system is configured to allow said second lubricant portion to flow into said accumulator and compress said volume of gas when said gas pressure is less than said total lubricant pressure.

* * * * *